US007787811B2

(12) United States Patent
Zappe et al.

(10) Patent No.: US 7,787,811 B2
(45) Date of Patent: Aug. 31, 2010

(54) CONTINUOUS INTERMEDIATE IMAGE CARRIER FOR AN ELECTROPHOTOGRAPHIC PRINTER OR COPIER

(75) Inventors: Karl Zappe, Schwindegg (DE); Uwe Milling, München (DE)

(73) Assignee: Oce Printing Systems GmbH, Poing (DE)

( * ) Notice: Subject to any disclaimer, the term of this patent is extended or adjusted under 35 U.S.C. 154(b) by 403 days.

(21) Appl. No.: 10/586,424

(22) PCT Filed: Nov. 15, 2004

(86) PCT No.: PCT/EP2004/012937

§ 371 (c)(1),
(2), (4) Date: Jul. 28, 2008

(87) PCT Pub. No.: WO2005/071494

PCT Pub. Date: Aug. 4, 2005

(65) Prior Publication Data

US 2009/0154965 A1 Jun. 18, 2009

(30) Foreign Application Priority Data

Jan. 23, 2004 (DE) ..... 10 2004 003 543

(51) Int. Cl.
*G03G 15/16* (2006.01)

(52) U.S. Cl. ..... 399/302; 399/308

(58) Field of Classification Search ..... 399/302, 399/308, 303, 313, 66, 306
See application file for complete search history.

(56) References Cited

U.S. PATENT DOCUMENTS

| | | | | |
|---|---|---|---|---|
| 5,572,304 | A | 11/1996 | Seto et al. | 399/313 |
| 6,592,812 | B1 | 7/2003 | Kubota et al. | 420/542 |
| 7,142,800 | B2 * | 11/2006 | Natori et al. | 399/302 |
| 7,150,908 | B2 * | 12/2006 | Terakawa et al. | 399/302 X |
| 2002/0146558 | A1 * | 10/2002 | Kamoshida et al. | 428/336 |
| 2003/0007810 | A1 * | 1/2003 | Enomoto et al. | 399/302 |

FOREIGN PATENT DOCUMENTS

| | | |
|---|---|---|
| DE | 195 02 098 | 11/1995 |
| JP | 64-91008 | 10/1989 |
| JP | 11073036 | 3/1999 |
| JP | 11352785 | 12/1999 |
| JP | 2000315020 | 11/2000 |
| JP | 2001034074 | 2/2001 |
| JP | 2002229346 | 8/2002 |
| WO | WO 00/14607 | 3/2000 |

* cited by examiner

*Primary Examiner*—Sophia S Chen
(74) *Attorney, Agent, or Firm*—Schiff Hardin LLP

(57) ABSTRACT

A continuous intermediate image carrier for an electrophotographic printer or copier has an electrical conductivity in a thickness direction between two opposite measurement points which is smaller than between two laterally-offset measurement points on opposite sides of the intermediate image carrier.

14 Claims, 10 Drawing Sheets

CONTINUOUS INTERMEDIATE IMAGE CARRIER FOR AN ELECTROPHOTOGRAPHIC PRINTER OR COPIER

BACKGROUND

The preferred embodiment concerns a continuous intermediate image carrier for an electrophotographic printer or copier that serves for acquisition, transport and/or delivery of a toner image in the electrophotographic printer or copier. A plurality of known electrophotographic printers, in particular color printers, comprise an intermediate carrier medium, advantageously a transfer belt. Individual color separations generated on a photoconductor with the aid of an electrophotographic method are successively printed in register one atop another from this photoconductor onto an intermediate carrier medium and are thereby collected on the intermediate carrier medium. The color separations printed over one another are subsequently transferred from the intermediate carrier medium onto a carrier material to be printed. Such known intermediate carrier media are typically comprised of synthetics (in particular elastomers) with a constant electrical conductivity. These known printers are typically single sheet printers with process speeds of <200 DIN A4 pages per minute. Such known intermediate carrier media are not suitable for qualitatively high-grade print results given process speeds of >200 pages A4 per minute.

The previously-known intermediate carrier media can essentially be associated into two groups. The intermediate carrier media of the first group are high-ohmic, whereby small transfer printing currents are required. Given small transfer printing currents, high-voltage power supplies with low efficiency can be cost-effectively used. Given these high-ohmic intermediate carrier media, the toner transfer onto the intermediate carrier medium and from the intermediate carrier medium also occurs with a relatively high efficiency. However, given the use of high-ohmic intermediate carrier media it is disadvantageous that it leads to what is known as a spraying of small characters even at relatively low process speeds, whereby the print quality is reduced. Given increasing process speeds it also leads to an electrostatic charging of the surface of the intermediate carrier medium.

Such an electrostatic charging leads to a destruction of the print image transferred onto the intermediate carrier medium due to sporadic, uncontrollable discharges. Given these discharges what are known as Lichtenberg figures are generated via which the print image located on the intermediate carrier medium is at least partially destroyed. The specific volume resistivity determined (with the aid of a measurement arrangement described in connection with FIGS. 4 through 8) at 10 V measurement voltage is greater than or equal to $10^{12}$ Ωcm given intermediate carrier media of the first group.

Relative to the intermediate carrier media of the first group, the intermediate carrier media of the second group are relatively low-ohmic. The specific volume resistivity determined (with the aid of a measurement arrangement described in connection with FIGS. 4 through 8) at 10 V measurement voltage is less than or equal to $10^{10}$ Ωcm given intermediate carrier media of the first group. Given these intermediate carrier media the sporadic, uncontrollable discharges are in fact prevented; however, the transfer of the toner images onto the intermediate carrier medium or from the intermediate carrier medium occurs with a relatively poor efficiency. Given low process speeds, a still-sufficient transfer of the toner images occurs via a relatively long residence time in the transfer printing region. In printers with intermediate carrier media of the second group, it is also known to use additional wax blades and Teflon rods that contact the surface of the intermediate carrier medium in order to reduce the surface energy of the intermediate carrier medium. The adhesion forces of the toner particles on the intermediate carrier medium should thereby be reduced and the toner transfer in the transfer printing regions should be made easier. However, in high-capacity printers with a print capacity of >200 sheets A4 per minute the transfer printing efficiency is significantly reduced due to the reduction of the residence time of the toner in the transfer printing regions at higher process speeds. The mentioned techniques for influencing the surface energy of the intermediate carrier medium then no longer lead to acceptable print results since the service lives of the intermediate carrier media are reduced via these techniques. Given a double-sided transfer printing of toner images onto carrier materials to be printed, further problems occur when the carrier material to be printed has a smaller width than the width of the intermediate carrier medium. This arrangement leads to a charge carrier exchange between the intermediate carrier media directly contacting in the regions adjacent to the carrier material when a first toner image on a first intermediate carrier medium is transfer-printed onto the front side of the carrier material and a second toner image is transfer-printed from a second intermediate carrier medium onto the back side of the carrier material in a common transfer printing region and the surfaces of the intermediate carrier media contact at least in one region adjacent to the carrier material. The intermediate carrier media adjacent to the carrier material are in direct contact, whereby an equalization current flows past laterally to the print substance. Due to this equalization current and the exchange of the charge carriers thereby affected given contacting of the surfaces of the intermediate carrier media, an interruption of the electrical field in the transfer printing region occurs as a result of the relatively good electrical conductivity of the low-ohmic intermediate carrier media.

Known intermediate carrier media are characterized by parameters specified in standards (such as, for example, ASTM D257 or IEC 60093), in particular characterized by the specific volume resistivity and the specific surface resistance. It is thereby assumed that the electrical properties of the intermediate carrier material are homogeneous and exhibit no direction-dependent properties.

A transfer belt that is comprised of at least two layers is known from the document JP-A-2000 315 020, whereby the upper layer has a higher resistance value than the other layers.

A transfer belt on whose top side are arranged two oppositely-situated layers is known from the document JP-A-11 352 785, whereby the volume resistivity of the outer layer is smaller than the volume resistivity of the underlying layer. The outer layer serves as a discharge layer. A transfer roller that comprises a plurality of layers arranged atop one another is known from the document JP-A-11 073 036, whereby at least one layer comprises a conductive powder (such as carbon or conductive metal oxide) that is arranged distributed in a polymer material.

An arrangement is known from the document JP-A-2001 034 074 in which the resistance of a continuous belt is determined in the thickness direction with the aid of two oppositely-situated electrodes.

SUMMARY

It is an object to specify an intermediate image carrier via which qualitatively high-grade print results are achieved even at relatively high process speeds.

A continuous intermediate image carrier for an electrophotographic printer or copier has an electrical conductivity in a thickness direction between two opposite measurement points which is smaller than between two laterally-offset measurement points on opposite sides of the intermediate image carrier.

DESCRIPTION OF THE PREFERRED EMBODIMENTS

Figure 1:
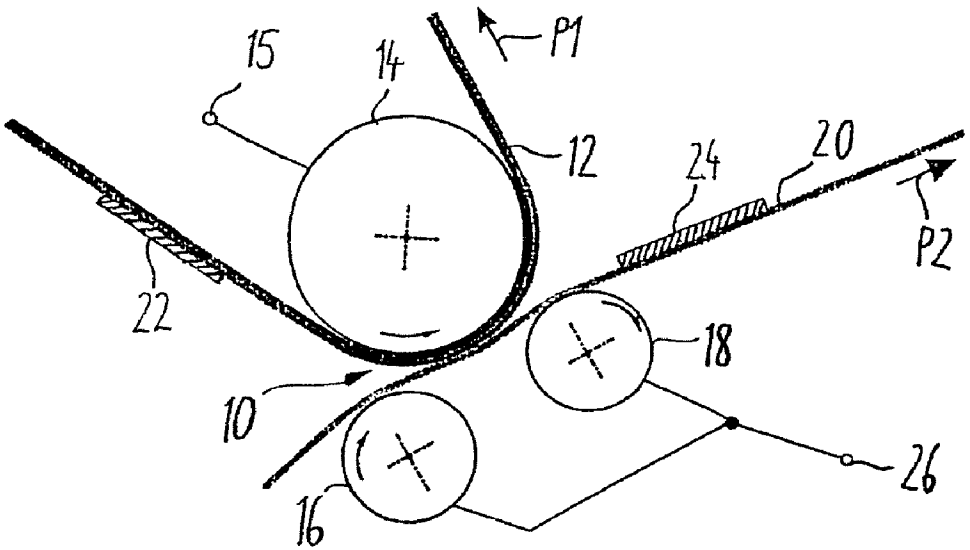
FIG. 1 is a schematic representation of a section of an electrophotographic printer at a transfer printing point for transfer of a toner image from a photoconductor belt onto a transfer belt.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The distinctiveness of the intermediate image carrier of the preferred embodiment is that its electrical conductivity in the thickness direction is smaller between two measurement points that are essentially directly opposite one another than between two laterally-offset measurement points. The advantages of high-ohmic carrier materials and the advantages of low-ohmic carrier materials can thereby be combined with one another in a simple manner without the respective disadvantages arising.

The electrical conductivity between the two laterally-offset measurement points can thus be selected in a simple manner at least so high that the ignition voltage of a gas discharge is prevented between the intermediate image carrier and an image carrier from which a toner image should be transferred onto the intermediate image carrier. The electrical conductivity of the intermediate image carrier can also be selected at least so low between the two laterally-offset measurement points and at least so high between the two measurement points essentially directly opposite one another that a sufficiently-large electrical field for transfer of the toner image from the intermediate image carrier onto a final image carrier can be generated in order to achieve a high transfer printing efficiency. The electrical conductivity of the intermediate image carrier in the thickness direction between the two measurement points essentially opposite one another can also be selected in a simple manner at least so low that partial discharges on the surface of the intermediate image carrier are prevented.

An intermediate image carrier with a different electrical conductivity between the described measurement points is thus suitable to be used even in high-capacity printers with process speeds >200 pages DIN A4 per minute and in full color printers with >50 pages DIN A4 per minute. Qualitatively high-grade print results can then also be achieved at such high process speeds.

A schematic representation of an electrophotographic printer is shown in FIG. 1, in which elements of the printer are shown at a transfer printing point 10 for transfer printing of toner images generated on a continuous photoconductor belt 12 onto a transfer belt 20. The photoconductor belt 12 is directed and driven via rollers of a belt drive (not shown), of which rollers a deflection roller 14 is arranged in a transfer printing region 10. The surface of the deflection roller 14 is connected with a ground potential 15 of the printer. The ground potential is 0 volts. The photoconductor belt 20 is driven in the direction of the arrow P1 with an essentially constant speed with the aid of a drive roller (not shown) of the belt drive.

The transfer belt 20 is a continuous belt that is directed and deflected via a plurality of rollers, whereby one of these rollers is executed as a drive roller. A first transfer roller 16 and a second transfer roller 18 are arranged in the transfer printing region 10 via which the transfer belt 20 is directed in the transfer printing region 10, whereby a common tangent of the first transfer roller 16 and of the second transfer roller 18 on the side facing towards the deflection roller 14 intersects at least the photoconductor belt 12, such that the transfer belt 20 passed in the direction of the arrow P2 by the photoconductor belt 12 in the transfer printing region 10 is pressed against the photoconductor belt 12 with a force dependent on the tension force of the transfer belt 20.

The photoconductor belt 12 is charged with the aid of a charge unit (not shown), in particular with the aid of a charge corotron, whereby regions of the charged photoconductor belt 12 are subsequently discharged with the aid of a character generator (in particular an LED character generator) corresponding to the print data supplied to the character generator. A charge image that corresponds to a latent print image is generated via the discharge of these regions of the photoconductor belt 12. This charge image is subsequently inked with toner material with the aid of a developer unit, advantageously via a magnetic brush, whereby a toner image 22 is generated on the photoconductor belt 12.

The toner image 22 is located on the surface of the photoconductor belt 12 and is transported on this into the transfer printing region 10. As already described, the deflection roller 14 has ground potential and the first transfer roller 16 and the second transfer roller 18 have a high voltage potential 26, advantageously in the range of 500 to 5000 volts. The transfer of the toner image 22 from the photoconductor belt 12 onto the transfer belt 20 in the transfer printing region 10 is abetted by this potential difference, such that after the transfer of the toner image 22 onto the transfer belt 20 only toner residues are still present on the surface of the photoconductor belt 12. The photoconductor belt 12 is discharged with the aid of a discharge unit after the transfer of the toner image 22. The toner residues still present on the photoconductor belt 12 are subsequently removed with the aid of a cleaning unit. A toner image already transferred onto the transfer belt 20 is designated with 24 in FIG. 1. The transfer printing of the toner image 22 from the photoconductor belt 12 onto the transfer belt 20 occurs with a slight pressing force with the aid of the arrangement shown in FIG. 1.

Figure 2:
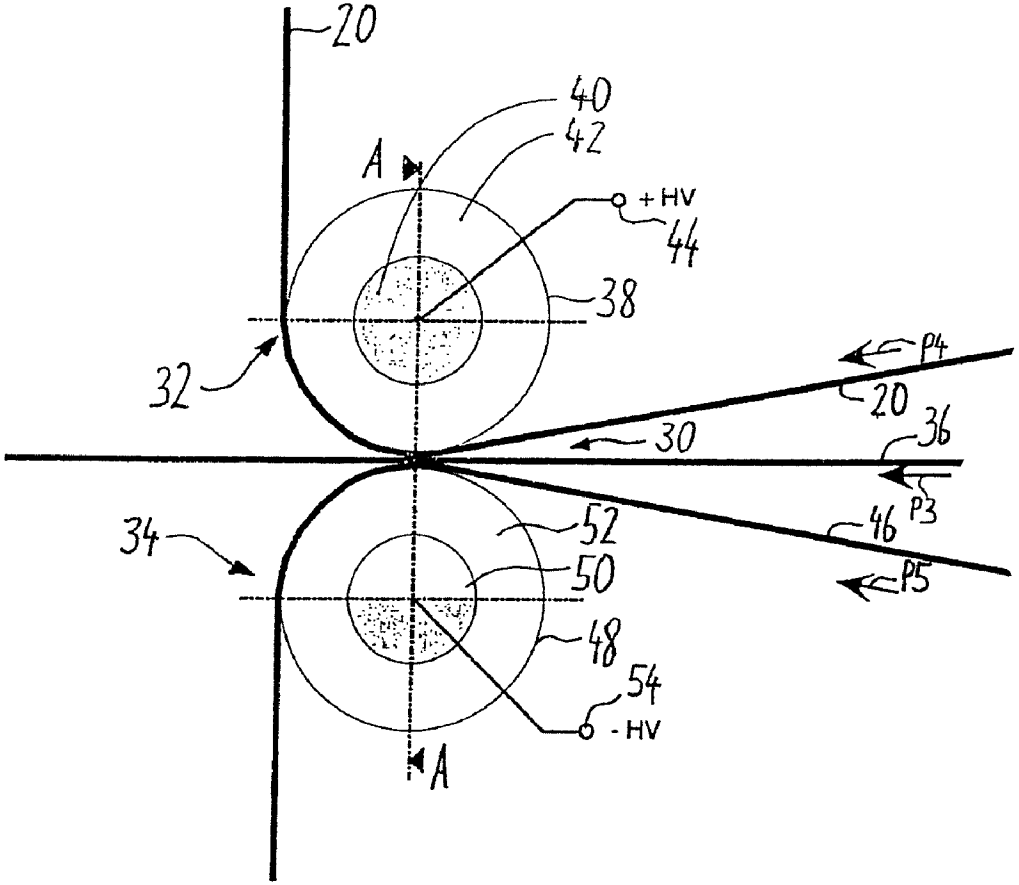
FIG. 2 is a schematic representation of a second section of an electrophotographic printer at a transfer printing point for transfer of respectively one toner image from two transfer belts onto a carrier material.

A second transfer printing point of the printer for transfer printing of toner images present on transfer belts 20, 46 onto a carrier material 36 is shown in FIG. 2. The transfer belt 20 is associated with a first printing group 32 for generation of print images for transfer printing onto the front side of the carrier material 36. Identical elements have identical reference characters. A toner image generated with the aid of the first printing group 32 (as described in connection with FIG. 1) and transferred onto the transfer belt 20 is transported in the direction of the arrow P4 into the transfer printing region 20 shown in FIG. 2. The toner images transported with the aid of the transfer belt 30 into the transfer printing region 30 are transfer-printed onto the front side of the carrier material 36 in the transfer printing region 30. In the transfer printing region 30, the transfer belt 20 is directed over a roller 38 that has a metallic roller core 40 and an electrically-conductive elastomer layer 42. The metallic roller core 40 is connected with a positive high voltage potential 44 (+HV) of approximately 3000 volts. The transfer belt 20 is a continuous belt and (as already described in connection with FIG. 1) is driven in the direction of the arrow P4 with the aid of a drive roller (not shown).

The transfer belt 46 is associated with a second printing group 34 that generates toner images for printing of the back side of the carrier material 36. In the transfer printing region 30, the transfer belt 46 is directed over a roller that has a metallic roller core 50 that is connected with a negative high voltage 54 (−HV) of approximately −3000 volts. An electrically-conductive elastomer layer 52 whose outer surface forms the roller surface surrounds the roller core 50. In the same manner as described in connection with FIG. 1, a toner image is generated on the photoconductor belt with the aid of the second printing group 34, which toner image is transferred from this photoconductor belt onto the transfer belt 46.

The transfer belt 46 is driven in the direction of the arrow P5 via a drive roller (not shown). A toner image transferred onto the transfer belt 46 is transported in the direction of the arrow P5 into the transfer printing region 30 and there is transferred onto the back side of the carrier material 36. The carrier material 36 is directed and driven in the direction of the arrow P3 with the aid of roller pairs (not shown).

The drive speed of the carrier material 36 is slightly less than the revolution speed of the transfer belts 20 and 46, such that a force in the direction of the arrow P3 is exerted on the carrier material 36 in the transfer printing region 30, such that the carrier material is held taut in the region before the transfer printing region 30 and what is known as a flutter of the carrier material 36 is prevented. The carrier material 36 is advantageously a continuous paper web.

Figure 3:
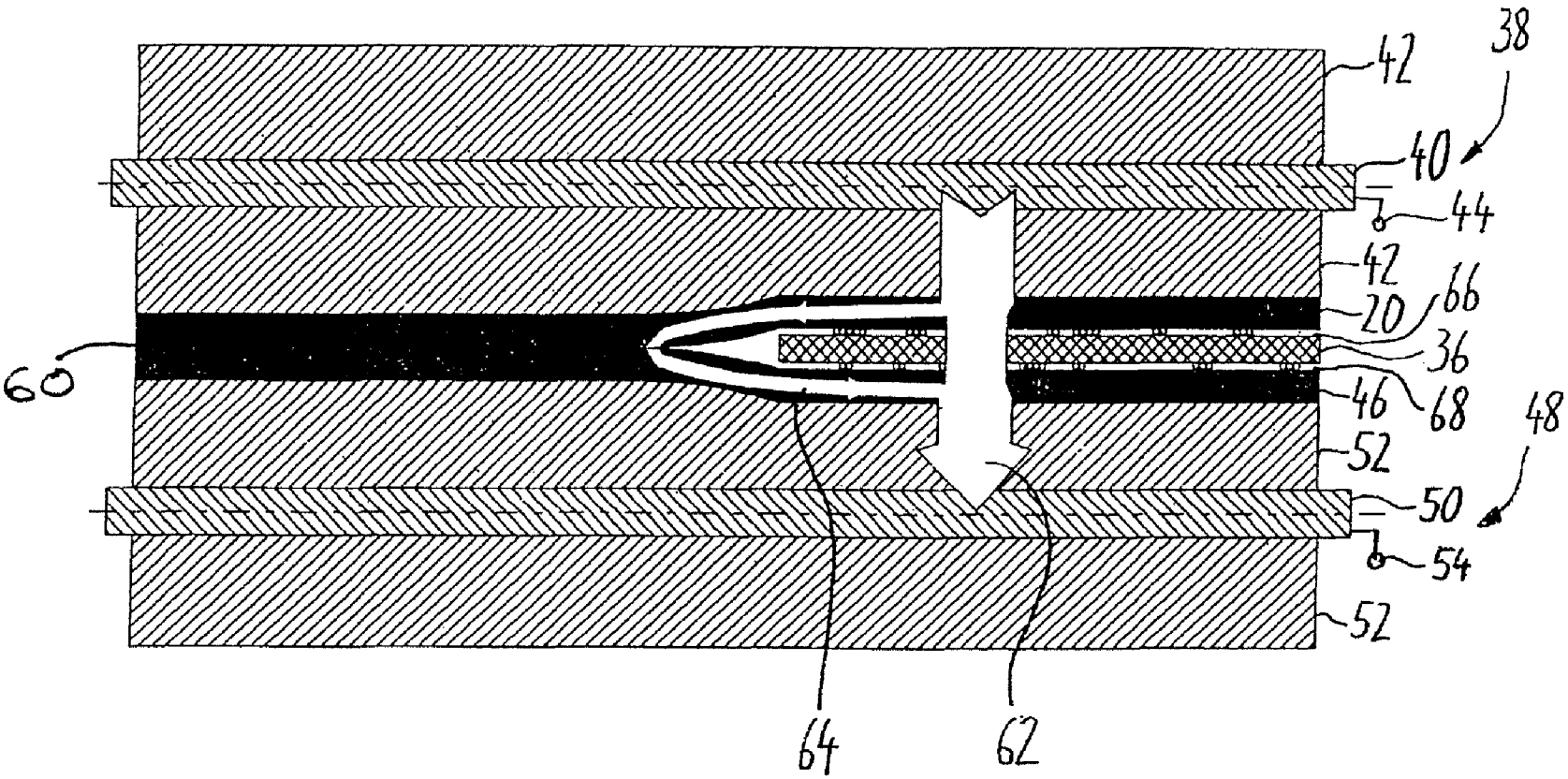
FIG. 3 is a section representation of the transfer belts and of the carrier material at the transfer printing point according to FIG. 2, whereby the current flow at the transfer printing point is schematically shown.

A section representation of the elements of the printer at the transfer printing point 30 is shown in FIG. 3 through the section axis A-A. Identical elements have identical reference characters. As already described in connection with FIG. 2, the metallic roller core 40 of the roller 38 is connected with the positive high voltage 44 (+HV) and the roller core 50 of the roller 48 is connected with negative high voltage 54 (−HV). Due to the potential difference between the positive high voltage 44 and the negative high voltage 54, a current 62 flows through the conductive elastomer layer 42, the transfer belt 20, the carrier material 36, the transfer belt 46, the conductive elastomer layer 52 to the roller core 50 of the roller 48. The surfaces of the transfer belts 20 and 46 have direct contact in a region 60 laterally adjacent to the carrier material 36, i.e. in the direction of the roller edge of the roller 38 and the roller edge of the roller 48. As indicated by the arrow 64, a slight current thus flows transversely through the transfer belt 20 and to a contact point of the transfer belt 20 with the transfer belt 46, into the transfer belt 46 towards the roller 48.

However, as indicated by the arrow 62 the primary portion of the total current between the rollers 38 and 48 occurs through the carrier material 36. Given too-low-ohmic carrier material, the current portion (characterized by the arrow 64) of the total current would increase, whereby the current portion 62 is reduced. The transfer printing efficiency in the transfer printing of the toner images from the transfer belts 20, 46 onto the carrier material 36 thereby decreases.

The toner material present on the surface of the transfer belt 20 in the form of a toner image is shown in gap 66 and is brought into contact with the carrier material 36 by the roller 38.

Toner particles are located on the transfer belt 46 in the form of a toner image for printing of the back side of the carrier material 36. The toner particles on the transfer belt 46 are shown in gap 68 in FIG. 3. The rollers 38 and 48 mutually serve as pressing rollers, whereby the outer sides of the transfer belts 20 and 46 are pressed against the front side or against the back side of the carrier material 36. The transfer of the toner particles from the respective transfer belt 20, 46 is at least abetted by the potential difference between the positive high voltage 44 and the negative high voltage 54. The potential difference is advantageously controlled or regulated with the aid of the total current flow between the roller core 40 and the roller core 50. According to FIG. 3, the total current flow between the roller cores 40 and 50 is comprised of the current flow 62 and the current flow 64.

Figure 4:
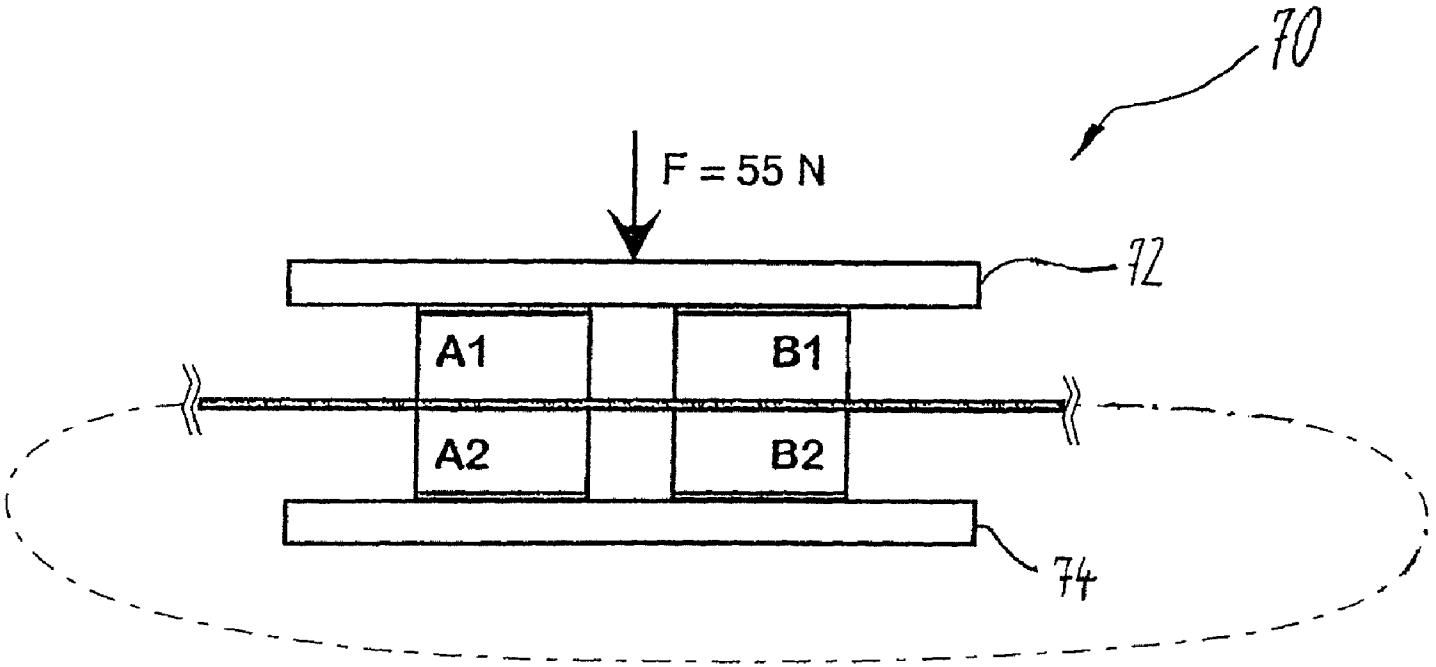
FIG. 4 is a side view of a measurement arrangement for determination of the electrical conductivity of the transfer belt.

A measurement arrangement for determination of the conductivity of the transfer belt 20 is shown in FIG. 4. Naturally, conductivities of other transfer belts (in particular of the transfer belt 46) can also be determined with the aid of the measurement arrangement shown in FIG. 4. The measurement device 70 has an upper contact arrangement 72 with contact elements A1 and B1. A lower contact arrangement 74 is also provided that comprises the contacts A2 and B2. The contacts A1, B1, A2 and B2 respectively have a quadratic contact surface of 20×20 mm associated with the transfer belt 20. The contact surfaces comprise stainless steel. The contact surfaces of the contacts A1 and A2 essentially congruently oppose another on opposite sides of the transfer belt 20. The contact surfaces of the contacts B1 and B2 are arranged in the same manner on opposite sides of the transfer belt 20. The contact surfaces of the contacts B1 and B2 also essentially oppose one another. The separation between the contacts A1 and B1 as well as between the contacts A2 and B2 is 10 mm. The contacts A1 and B1 are pressed against the contacts A2 and B2 with a force F of 55 N, whereby the contact surfaces of the contacts A1 and B1 as well as A2 and B2 are respectively pressed against the front side or the back side of the transfer belt 20 with a force of 55 N.

Figure 5:
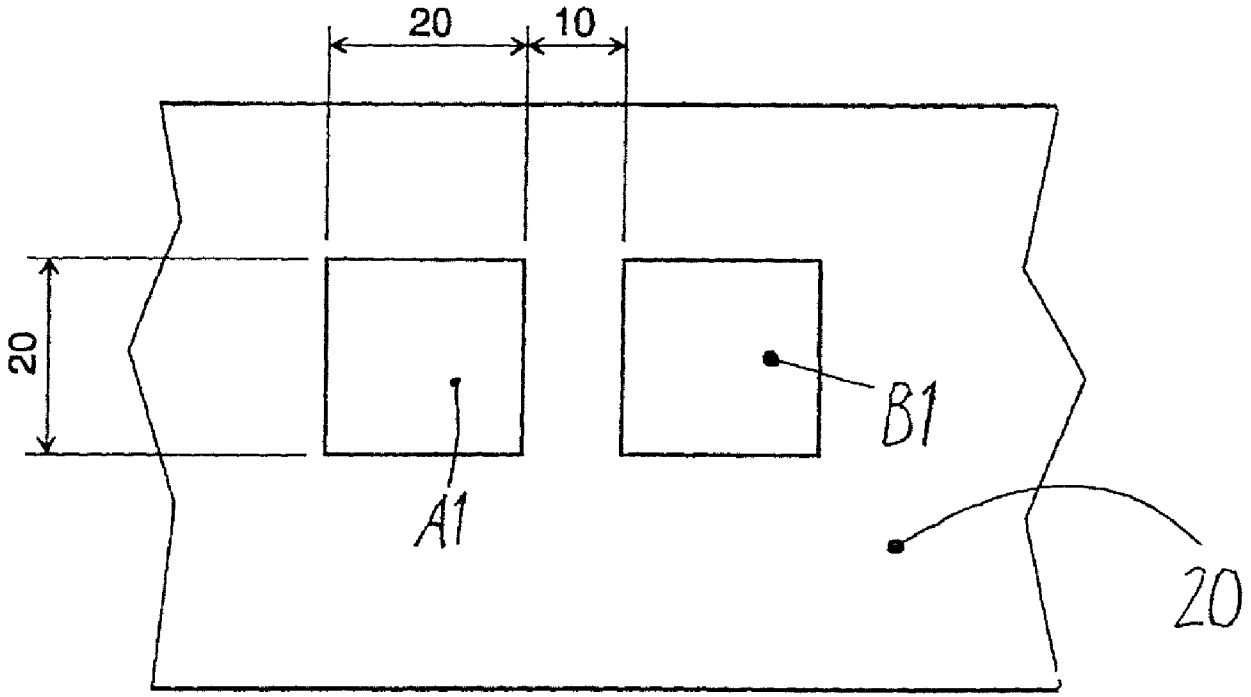
FIG. 5 is a representation of the contact surfaces of the measurement arrangement according to FIG. 4.

A section of the transfer belt 20 on which the contact surfaces of the contacts A1 and B1 are represented by a solid line is shown in FIG. 5. As already described in connection with FIG. 4, the contacts A1, B1, A2 and B2 respectively have a quadratic base of 20×20 mm. The contacts are also arranged at a separation of 10 mm.

Figure 6:
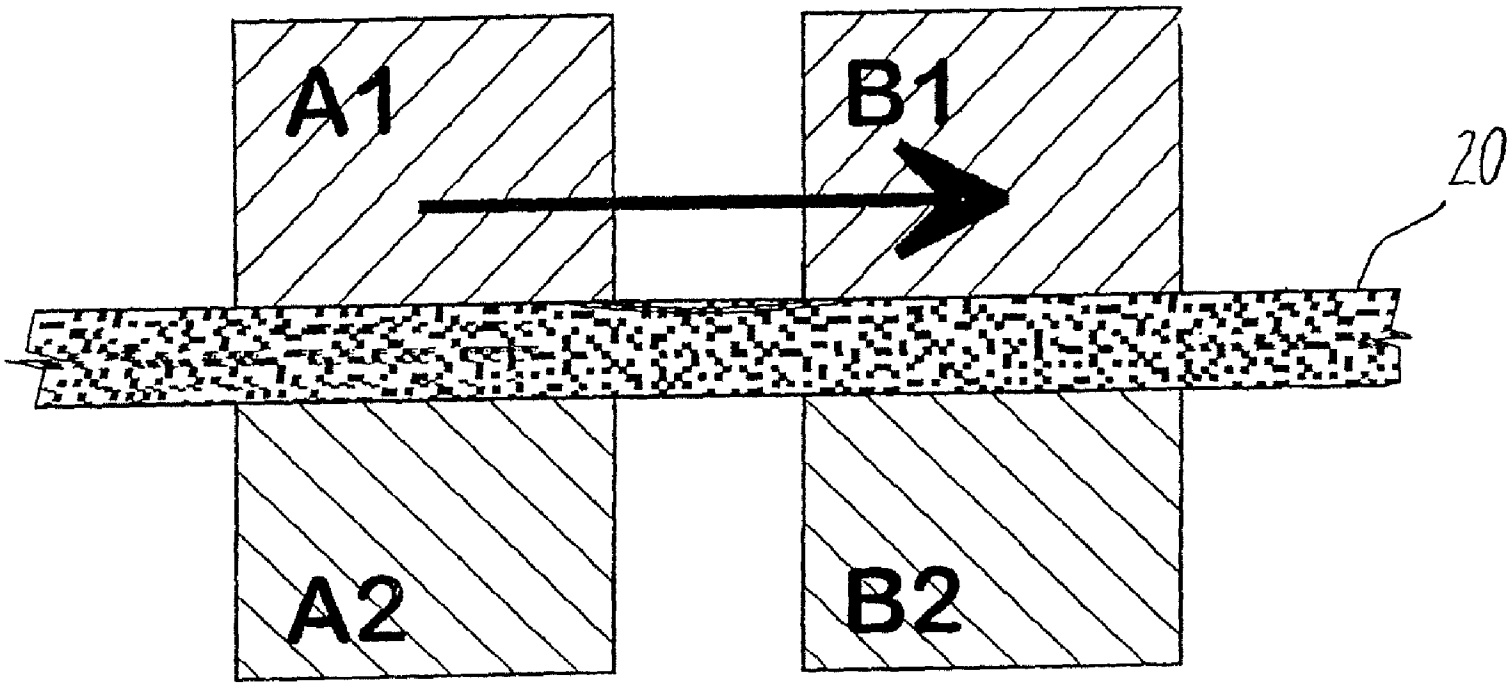
FIG. 6 is a section representation of the measurement arrangement according to FIGS. 4 and 5 for measurement of the conductivity of the transfer belt on its surface.

A section representation through the measurement device 70 according to FIG. 4 is shown in FIG. 6, whereby the conductivity of the transfer belt 20 between the contact surfaces of the contacts A1 and B1 is determined. The conductivity between two points on the surface of the transfer belt 20 in its outside major surface direction is thus determined with the aid of this measurement. Alternatively, the conductivity between two points on the surface of the transfer belt 20 transverse to its outside major surface direction or at an angle to its outside major surface direction can also be determined.

Figure 7:
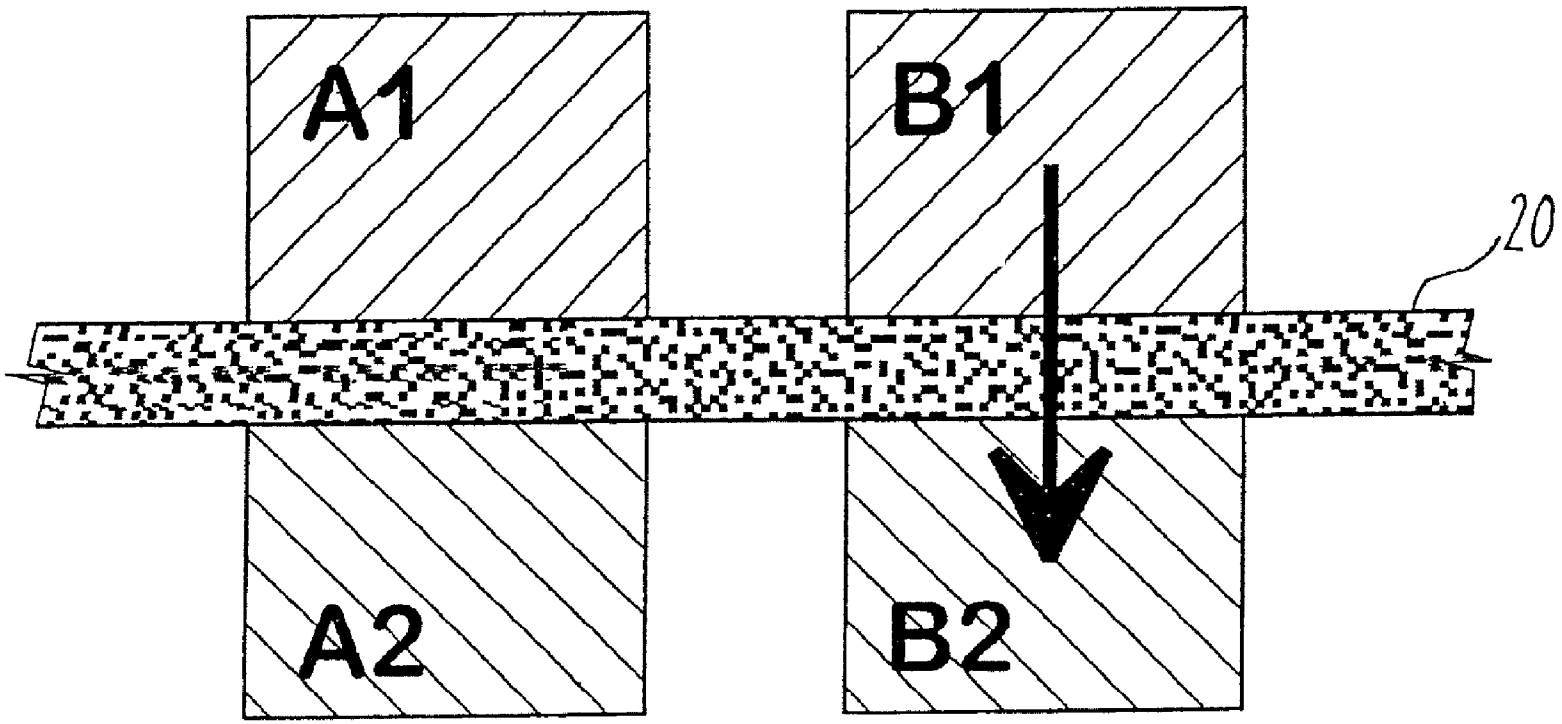
FIG. 7 is the section representation of the measurement device according to FIG. 6, whereby the electrical conductivity of the transfer belt is determined between two substantially opposite measurement points.

The section representation of the measurement device 70 according to FIG. 6 is shown in FIG. 7, whereby the conductivity of the transfer belt in the thickness direction (and thus the specific volume resistivity of the transfer belt 20) is determined between the contact surfaces of the contacts B1 and B2.

Figure 8:
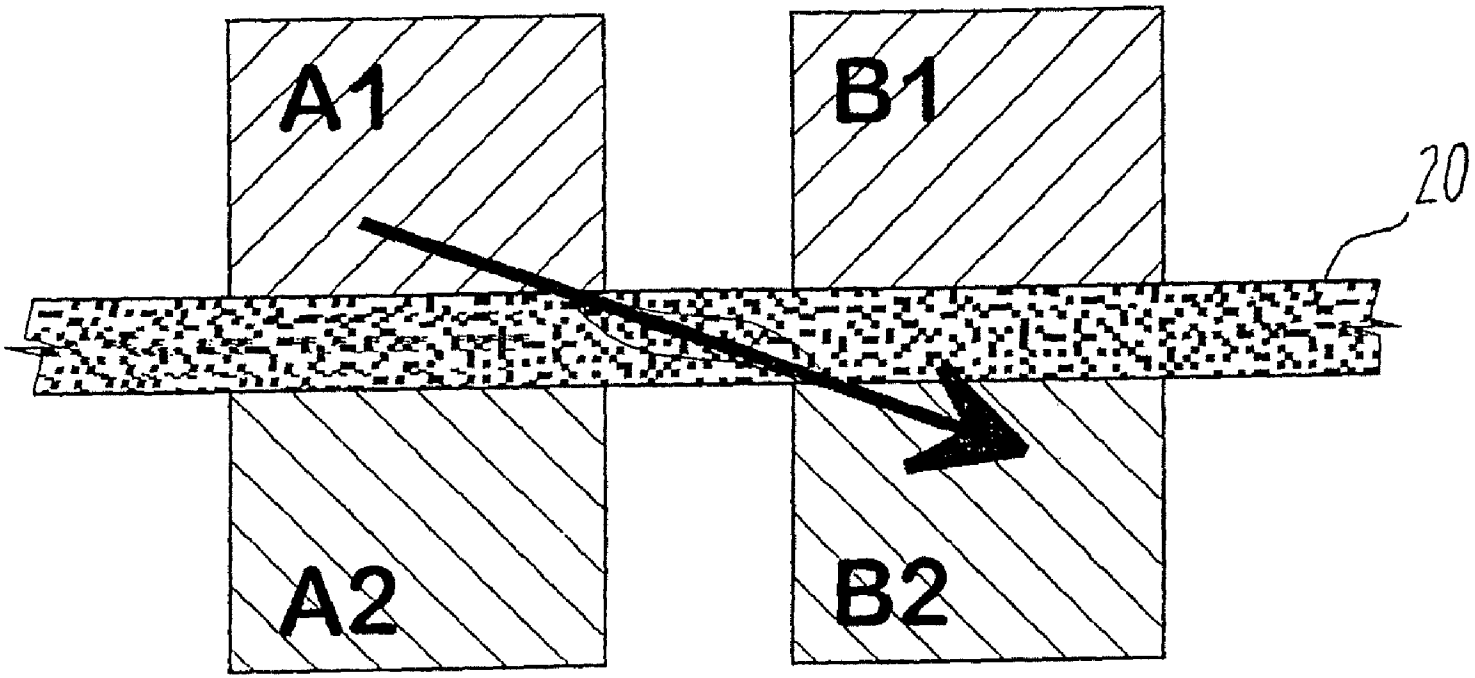
FIG. 8 is the section representation of the measurement device according to FIGS. 6 and 7, whereby the electrical conductivity of the carrier material is determined between two laterally opposite measurement points.

The section representation of the measurement arrangement is shown in FIG. 8 similar to FIGS. 6 and 7. The conductivity of the transfer belt between the two laterally offset contact surfaces of the contacts A1 and B2 is determined with the aid of the shown measurement arrangement. The resistance determined (with the aid of this measurement arrangement) between the contact surfaces of the contacts A1 and B2, corresponding to the conductivity, is also designated in this patent application as a transverse resistance. This transverse resistance is decisive for the electrical properties of a transfer belt 20 in an electrophotographic printer with high print speed in order to prevent the disadvantages occurring in the prior art. The effects of the transverse resistance on the electrophotographic process in the printer are subsequently explained in further detail in connection with FIGS. 9 and 10.

Alternative to the described measurement arrangement, the sizes and separations as well as the contact materials of the contacts A1, B1, A2 and B2 can be varied.

Figure 9:
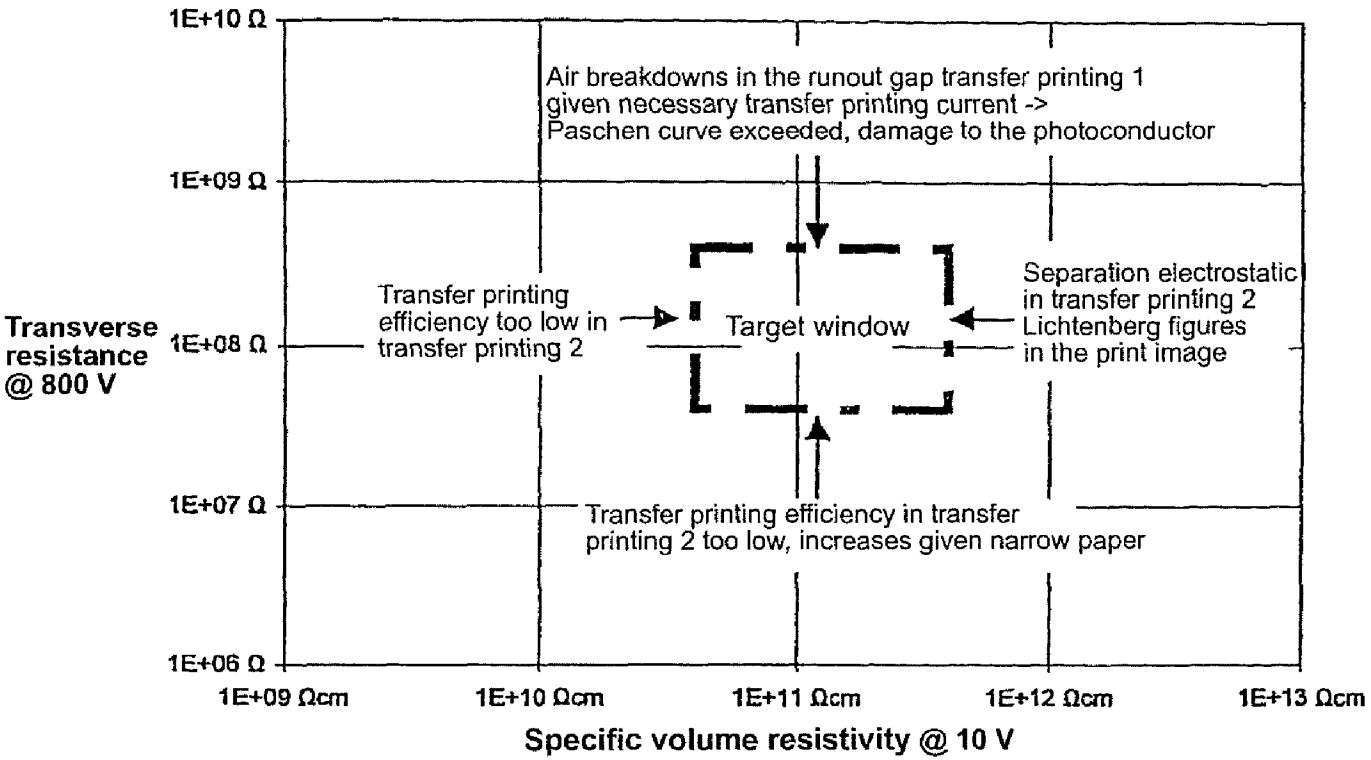
FIG. 9 is a diagram in which the requirements for the electrical conductivity of the transfer belt is shown with the aid of a representation of a transverse resistance of the transfer belt dependent on a specific volume resistivity of the transfer belt.

In FIG. 9 a diagram is shown in which the dependency of the transverse resistance of the transfer belt 20 on its specific volume resistivity is specified. The target range (identified with the aid of a thick dash-dot line) comprises resistance ratios of the transverse resistance and specific volume resistivity that a transfer belt 20 of the preferred embodiment should ideally have. However, the preferred embodiment is not limited to this value range. Given a direct voltage of 800 volts, the transverse resistance between the contact surfaces of the contacts A1 and B2 has been determined with the measurement arrangement according to FIG. 8. The specific volume resistivity between the contact surfaces B1 and B2 has been determined with the measurement arrangement according to FIG. 7 given a measurement voltage of 10 volts direct voltage.

Given a transverse resistance of $<4\cdot10^{7}\Omega$, the transfer printing efficiency in the transfer printing of the toner image from the transfer belt 20 onto the carrier material 36 decreases such that only a part of the carrier material is transfer-printed. A toner image with only insufficient inking on the carrier material 36 is thereby generated. The toner material remaining on the transfer belt 20 must also be cleaned from this. If the entire toner material remaining on the transfer belt 20 cannot be removed with the aid of the cleaning device provided to clean the transfer belt 20, given subsequent print carrier material 36, which Lichtenberg figures are visible in a subsequent fixed print image and significantly degrade the print quality of the print image.

Figure 10:
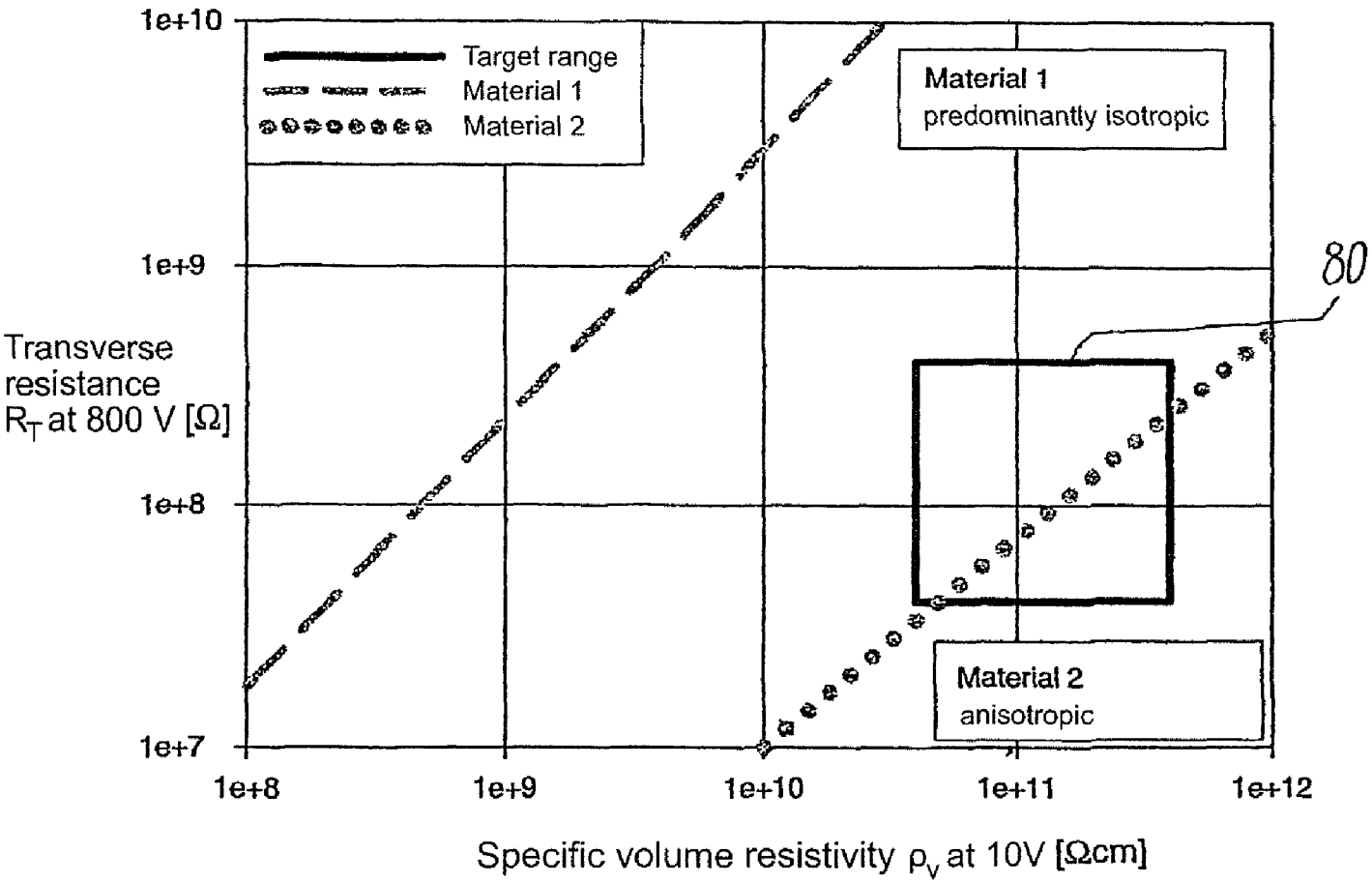
FIG. 10 is a section of the diagram according to FIG. 9, in which the dependencies of the transverse resistance on the specific volume resistivity of a first transfer belt type and a second transfer belt type are shown.

The properties of the transverse resistance and of the specific volume resistance of various tested materials are plotted in FIG. 10. The transfer belts used in known printers thereby form a first material group that is represented as a dashed line in the diagram according to FIG. 10. The dashed line thereby indicates a linearized curve that has been determined from a plurality of measurement values of different transfer belts of the prior art. The resistance ratios of the transverse resistances and of the specific volume resistivities of transfer belts 20, 46 of a second material group that have anisotropic material properties have been plotted linearized with the aid of a dotted line in the diagram according to FIG. 10. The electrical conductivity of the transfer belts 20, 46 of the second material group is significantly less in the thickness direction between two measurement points that are essentially directly opposite than between two laterally-offset measurement points. In testing with a specific printer type, it has emerged that the materials whose ratio of transverse resistance to specific volume resistivity arranged in the region 80 enclosed by a solid line in the diagram according to FIG. 10 are particularly suitable. Excellent print results have been achieved with these transfer belts 20, 46, even at high process speeds >200 sheets DIN A4 per minute.

According to the preferred embodiment it is thus advantageous to use defined, anisotropic conductive materials as a transfer belt 20, 36. A high print quality is provided, even at high process speeds as well as in duplex printing, in particular via the selection of a suitable transit resistance in the thickness direction, i.e. via the selection of the specific volume resistivity and the selection of a suitable transverse resistance. An optimal print quality and a high rotary piston efficiency is ensured even at high process speeds and given the use of paper webs or individual sheets of varying width. The specific volume resistivity is advantageously in the range from $4\cdot10^{10}$ Ωcm to images these toner residues are possibly transfer-printed onto the carrier material 36, whereby only low-grade print images or maculature is generated.

If the transverse resistance of the transfer belt 20 is, however, greater than $4\cdot10^{8}\Omega$, the danger of electrical discharges (what are known as air breakdowns) is present in the transfer printing region 10 given transfer printing of the toner images from the photoconductor belt 12 onto the transfer belt 20. These electrical discharges primarily occur in the region after the contact point of both belts, i.e. of the photoconductor belt 12 and the transfer belt 20. This region is also designated as a runout gap of the transfer printing region 10. As already described, the high voltage for generation of the potential difference in the transfer printing region 10 is set based on the transfer printing current flowing between the ground potential 15 and the high voltage 26. Given high transverse resistance, a relatively high voltage will thus be set in order to set the transfer printing current to the necessary preset value. Given resistance values of the transverse resistance $>4\cdot10^{8}\Omega$, however, in printers of this exemplary embodiment what is known as the Paschen curve is typically exceeded and gas discharges occur in the run-out gap.

Given a specific volume resistivity of $<4\cdot10^{10}$ Ωcm, the transfer printing efficiency is likewise too low given transfer printing of the toner images from the transfer belt 20 or 46 onto the carrier material 36. The same disadvantageous effects as already described further above in connection with a too-low transverse resistance of the transfer belt 20 thereby occur.

Given a specific volume resistivity of $>8\cdot10^{11}$ Ωcm, the danger exists that gas discharges and electrical flashovers occur in the transfer printing region 30 given the transfer printing of the toner images located on the transfer belts 20 and 46 onto the carrier material 36, whereby what are known as Lichtenberg figures arise in the toner images transfer-printed onto the carrier material 36, which Lichtenberg figures are visible in a subsequent fixed print image and significantly degrade the print quality of the print image.

The properties of the transverse resistance and of the specific volume resistance of various tested materials are plotted in FIG. 10. The transfer belts used in known printers thereby form a first material group that is represented as a dashed line in the diagram according to FIG. 10. The dashed line thereby indicates a linearized curve that has been determined from a plurality of measurement values of different transfer belts of the prior art. The resistance ratios of the transverse resistances and of the specific volume resistivities of transfer belts 20, 46 of a second material group that have anisotropic material properties have been plotted linearized with the aid of a dotted line in the diagram according to FIG. 10. The electrical conductivity of the transfer belts 20, 46 of the second material group is significantly less in the thickness direction between two measurement points that are essentially directly opposite than between two laterally-offset measurement points. In testing with a specific printer type, it has emerged that the materials whose ratio of transverse resistance to specific volume resistivity arranged in the region 80 enclosed by a solid line in the diagram according to FIG. 10 are particularly suitable. Excellent print results have been achieved with these transfer belts 20, 46, even at high process speeds >200 sheets DIN A4 per minute.

According to the preferred embodiment it is thus advantageous to use defined, anisotropic conductive materials as a transfer belt 20, 36. A high print quality is provided, even at high process speeds as well as in duplex printing, in particular via the selection of a suitable transit resistance in the thickness direction, i.e. via the selection of the specific volume resistivity and the selection of a suitable transverse resistance. An optimal print quality and a high rotary piston efficiency is ensured even at high process speeds and given the use of paper webs or individual sheets of varying width. The specific volume resistivity is advantageously in the range from $4\cdot10^{10}$ Ωcm to $8\cdot10^{11}$ Ωcm, which has been determined given a measurement voltage of 10 volts. The transverse resistance advantageously lies in a range between $4\cdot10^{7}\Omega$ to $4\cdot10^{8}\Omega$, which has been determined given a measurement voltage of 800 volts.

The transfer belts 20, 46 are advantageously continuous belts with a thickness between 50 μm and 1000 μm given a length of 1000 mm to 30000 mm and a width in the range between 100 mm and 1000 mm. The transfer belts 20, 46 comprise an electrically-insulating synthetic in which are dispersed conductive particles (such as, for example, carbon black or metallic material). Ionic conductive additives such as, for example, salts or conductive synthetics (in particular polyaniline) can alternatively or additionally be introduced into the insulating elastomer. These particles are then introduced into the base material 10 with a suitable distribution, aligned and agglomerated such that the transfer belt 20, 46 has the desired anisotropic properties. The insulating synthetic can, for example, be an elastomer.

Alternatively, the transfer belt 20, 46 can also be produced from a plurality of layers of various synthetics with different conductivity. The layers advantageously run parallel to the surface of the transfer belt 20, 46.

The desired anisotropic electrical properties of the transfer belt 20, 46 can be generated via the combination of synthetic layers with different slice thickness and conductivities, whereby at least one of the synthetic layers has anisotropic electrical properties. In other embodiments it is also possible that all synthetic layers have anisotropic electrical properties. The individual layers can also be produced from isotropic conductive elastomers, whereby an anisotropic total composite of the transfer belt 20, 46 is generated given a suitable selection of suitable conductivities and layer thicknesses of the individual layers.

Although preferred exemplary embodiments have been shown and described in detail in the drawings and in the preceding specification, they should be viewed as purely exemplary and not as limiting the invention. It is noted that only the preferred exemplary embodiments are shown and described, and all variations and modifications that presently or in the future lie within the protective scope of the invention should be protected.

We claim as our invention:

1. A continuous intermediate image carrier for an electrophotographic printer or copier, comprising:

at least one layer which comprises an electrically-insulating synthetic in which are dispersed conductive particles to provide an anisotropic conductive layer having an anisotropic property such that a first electrical conductivity in a thickness direction of the layer is smaller than a second electrical conductivity in a transverse direction of the layer.

2. The intermediate image carrier of claim 1 wherein a toner image made up of electrically-charged toner particles and present on an image carrier can be transferred onto said intermediate image carrier in a first transfer printing region, and the transferred toner image can be transferred from the intermediate image carrier onto a final image carrier.

3. The intermediate image carrier according to claim 2 wherein the image carrier comprises a photoconductor.

4. The intermediate image carrier according to claim 2 wherein a plurality of toner images can be transferred from the image carrier onto the intermediate image carrier in a first operating mode, said toner images being substantially printed atop one another on the intermediate image carrier, and toner images printed atop one another can be mutually transferred onto the final image carrier in a second operating mode.

5. The image carrier of claim 1 wherein said second electrical conductivity in said transverse direction is at least so great that in an ignition voltage of a gas discharge is prevented between the intermediate image carrier and an image carrier from which a toner image is transferred to the intermediate image carrier.

6. The intermediate image carrier according to claim 1 wherein the second electrical conductivity in the transverse direction is at least so low that a sufficiently large electrical field can be generated for transfer of a toner image from the intermediate image carrier onto a final image carrier as well as from an image carrier onto the intermediate image carrier.

7. The intermediate image carrier according to claim 1 wherein said first electrical conductivity in the thickness direction is at least so low that partial discharges on a surface of the intermediate image carrier are prevented.

8. The intermediate image carrier according to claim 1 wherein said second electrical conductivity in said transverse direction is at least so low that a sufficiently large electrical field for transfer of a toner image can be generated at a transfer printing point for transfer of the toner image.

9. The intermediate image carrier according to claim 1 wherein the intermediate image carrier comprises a transfer belt or a transfer drum.

10. The intermediate image carrier according to claim 1 wherein said first electrical conductivity in said thickness direction corresponds to a specific volume resistivity in a range from 1E+10 Ωcm to 1E+12 Ωcm.

11. The intermediate image carrier according to claim 10 wherein the specific volume resistivity can be determined with aid of a first electrical contact surface on a top side of the intermediate image carrier and a second contact surface substantially opposite the first contact surface on an underside of the intermediate image carrier, a measurement voltage being 800 volts direct voltage.

12. The intermediate image carrier according to claim 1 wherein a third electrical conductivity on a surface of said intermediate image carrier is at least so great that an electrical flash over is prevented between the intermediate image carrier and a further image carrier.

13. The intermediate image carrier according to claim 1 wherein said second electrical conductivity in said transverse direction corresponds to a specific volume resistivity in a range between 1E+7 Ωcm and 1E+11 Ωcm.

14. The intermediate image carrier according to claim 1 wherein said second electrical conductivity in said transverse direction corresponds to a transverse resistance measured between laterally offset contacts on opposite surfaces of said layer and in a range between $4 \cdot 10^7 \Omega$ to $4 \cdot 10^8 \Omega$ determined given a measurement voltage of 800 volts.

* * * * *